US008118409B2

(12) United States Patent
Asako

(10) Patent No.: US 8,118,409 B2
(45) Date of Patent: Feb. 21, 2012

(54) ACOUSTIC INK JET PRINTER

(75) Inventor: Kenichiro Asako, Kokubunji (JP)

(73) Assignee: Casio Computer Co., Ltd., Tokyo (JP)

( * ) Notice: Subject to any disclaimer, the term of this patent is extended or adjusted under 35 U.S.C. 154(b) by 386 days.

(21) Appl. No.: 12/481,023

(22) Filed: Jun. 9, 2009

(65) Prior Publication Data

US 2009/0303294 A1 Dec. 10, 2009

(30) Foreign Application Priority Data

Jun. 9, 2008 (JP) ..... 2008-150120

(51) Int. Cl.
*B41J 2/045* (2006.01)

(52) U.S. Cl. ..... 347/68; 347/74

(58) Field of Classification Search ..... None
See application file for complete search history.

(56) References Cited

U.S. PATENT DOCUMENTS 6,273,551 B1 * 8/2001 Guerin et al. ..... 347/46

FOREIGN PATENT DOCUMENTS

JP 8-309968 A 11/1996
JP 2001-232793 A 8/2001

* cited by examiner

*Primary Examiner* — Matthew Luu
*Assistant Examiner* — Erica Lin
(74) *Attorney, Agent, or Firm* — Holtz, Holtz, Goodman & Chick, PC

(57) ABSTRACT

In an acoustic ink jet printer, a configuration is such that an ink unit 5*b* and a piezoelectric body unit 5*a* are separated, and a printing is carried out by the ink unit moving on the piezoelectric body unit. Herein, a configuration is such that a plurality of ink cartridges are disposed on a recording head 5. Also, at this time, a configuration is such that only necessary ink cartridges are disposed on the recording head. An acoustic ink jet printer is obtained with which a replacement of a head unit is unnecessary even in the event of a clogging or the like occurring in a nozzle, and with which, the structure of the ink cartridges being simplified, and furthermore, a simplification of the apparatus being achieved even when colorizing, a reduction in cost is possible.

20 Claims, 10 Drawing Sheets

ACOUSTIC INK JET PRINTER

BACKGROUND OF THE INVENTION

1. Field of the Invention

The present invention relates to an acoustic ink jet type recording apparatus (an acoustic ink jet printer).

2. Description of the Related Art

To date, as acoustic ink jet printers, ones having various structures have been known.

For example, an acoustic ink jet printer disclosed in JP-A-2001-232793 is known wherein ink is caused to be spattered from a nozzle of a recording head by a vibration, and a recording printing is carried out on recording paper.

However, with the heretofore described kind of heretofore known ink jet printer, it is necessary to replace a head unit, including the expensive recording head, in the event that the nozzle clogs, which is a factor in an increase in cost. Furthermore, an ink cartridge with a complex structure is necessary, which point is also a cause of an increase in cost.

Also, when aiming for a colorization of the printer, it is necessary to prepare a spattering oscillator, or the like, for each color, which is a cause of complicating the apparatus, and of an increase in cost.

The invention having been contrived bearing in mind this kind of circumstance, an object thereof is to obtain an ink jet printer with which a replacement of the whole head unit is unnecessary even in the event of a clogging or the like occurring in the nozzle, and with which, a simplification of the structure of the ink cartridge being possible, and furthermore, a simplification of the apparatus being achieved even when colorizing, a reduction in cost is possible.

SUMMARY OF THE INVENTION

In order to achieve this kind of object, according to one aspect of the invention, an acoustic ink jet printer in which ink is selectively spattered onto recording paper from a recording head, and a printing carried out, is configured in such a way as to divide the recording head into an ink unit and piezoelectric body unit, and carry out a printing by moving the ink unit on the piezoelectric body unit.

According to one aspect of the invention, an acoustic ink jet printer in which ink is selectively spattered onto recording paper from a recording head, and a printing carried out, is configured in such a way as to divide the recording head into an ink unit and piezoelectric body unit and, as well as disposing the piezoelectric body unit penetrating the ink unit, carry out a printing by moving the ink unit in a main scanning direction.

The acoustic ink jet printer according to one aspect of the invention is configured in such a way as to use a plurality of ink cartridges as the ink unit, and dispose the plurality of ink cartridges on the piezoelectric body unit.

The acoustic ink jet printer according to the first or second aspect of the invention is configured in such a way as to use only necessary ink cartridges as the ink unit, and dispose only the necessary number of ink cartridges on the piezoelectric body unit.

As heretofore described, according to one aspect of the invention, as the acoustic ink jet printer is configured in such a way as to divide the recording head into the ink unit (the ink cartridge, or the like) and piezoelectric body unit (a recording head unit), and move the ink unit on the piezoelectric body unit, it is possible to use an ink unit (the ink cartridge, or the like) with a simple configuration, by which means it is possible to achieve a reduction in cost.

Also, according to one aspect of the invention, there is no need to replace the whole of the expensive recording head even in the event of a problem occurring, and furthermore, with regard to the ink spattering too, as heat is not used, there is also an advantage in that there is a wide range of choice of ink.

Also, according to one aspect of the invention, as the acoustic ink jet printer is configured in such a way as to divide the recording head into the ink unit and piezoelectric body unit, cause the piezoelectric body unit to penetrate the ink unit, and carry out a printing by moving the ink unit in the main scanning direction, it is possible to use an ink unit (the ink cartridge, or the like) with a simple configuration, meaning that it is possible to achieve a reduction in cost. Furthermore, according to one aspect of the invention, even in the event that a problem such as a clogging of the nozzle occurs, it being possible to resolve it by replacing only the ink cartridge, there is no need to replace the expensive recording head unit. Also, as heat is not used, there is a superior advantage such as there being a wide range of choice of ink.

Also, according to one aspect of the invention, as a color printing is possible with one recording head (piezoelectric body unit), a color printing is possible using a simple method, and a reduction in cost is possible.

Furthermore, according to one aspect of the invention, as an ink cartridge of a color not needed for the printing is left set aside in a place for setting aside, and does not need to be moved, there is an advantage in that it is possible to continue a capping for longer, and it is possible to obtain a more stable printing.

BRIEF DESCRIPTION OF THE DRAWINGS

FIG. 11 is a diagram of FIG. 10 seen from a direction of an arrow a;

DETAILED DESCRIPTION OF THE PREFERRED EMBODIMENTS

FIGS. 1 to 6C show a first embodiment of an acoustic ink jet printer according to the invention.

Herein, in the diagrams, in an acoustic ink jet printer, using an acoustic ink jet recording method, to which the invention is applied, ink droplets are selectively spattered from a nozzle of a recording head onto recording paper, compiling a recording pattern on the recording paper.

Figure 1:
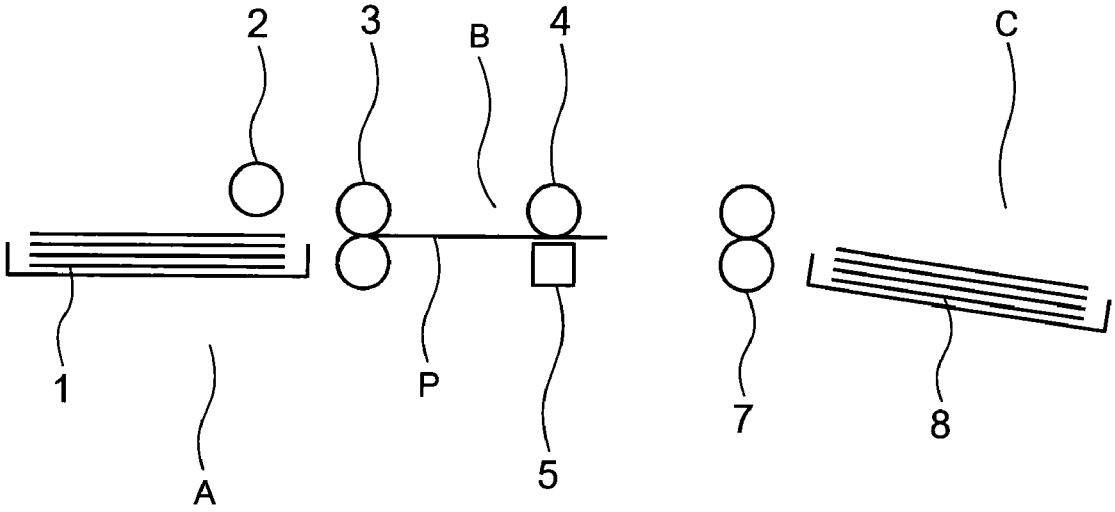
FIG. 1 is a schematic sectional diagram showing one embodiment of an acoustic ink jet printer according to the invention.
Figure 2:
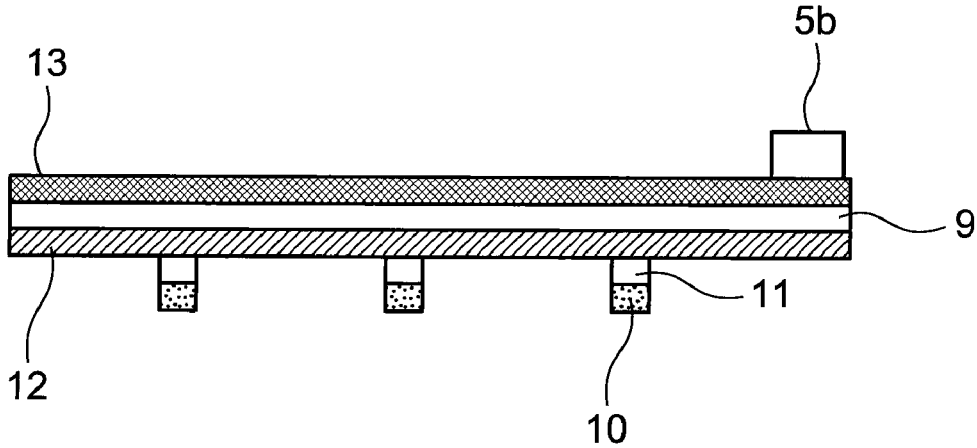
FIG. 2 is an outline diagram showing a configuration of a recording head included in the acoustic ink jet printer according to the invention.

FIG. 1 shows a schematic sectional diagram of the acoustic ink jet printer according to the invention.

That is, the acoustic ink jet printer is configured of, basically, a paper supply unit A, a recording unit B, and a paper ejection unit C.

The paper supply unit A, being configured of a paper supply cassette 1 and a paper supply roller 2, supplies paper P to the recording unit B in response to a paper supply control signal sent from an unshown central calculation device.

The recording unit B is configured of a conveyor roller A3, a conveyor roller B7, a platen roller 4, and a recording head 5. A serial type is employed for the recording head 5. Ink I is spattered toward the paper P from the recording head 5 in accordance with printing data, and a recording is carried out. Ink is supplied as necessary to the recording head 5 from an ink tank (not shown). The paper P on which the recording in the recording unit B is completed heads toward the paper ejection unit C due to a rotation of the conveyor roller B7.

In the paper ejection unit C, the paper P on which the recording is completed is stacked on a paper ejection tray 8.

FIGS. 2 to 6C show a configuration of the recording head 5.

The recording head 5 is configured of a recording head unit 5*a* (that is, a piezoelectric body unit) and an ink cartridge 5*b*. Herein, the recording head unit 5*a* (that is, the piezoelectric body unit) is fixed at a size such that a recording can be carried out over the whole width of the paper (in a main scanning direction) in the recording unit B.

The ink cartridge 5*b*, being disposed in contact with the recording head unit 5*a* (that is, the piezoelectric body unit) as a unit holding the ink, is disposed in a condition in which it can move, by means of an unshown guide rod, timing belt, and drive motor, on the recording head unit 5*a* in a paper width direction (the main scanning direction). A coupling material 13 being applied between the recording head unit 5*a* (that is, the piezoelectric body unit) and the ink cartridge 5*b*, an ultrasonic wave generated in the recording head unit 5*a* (that is, the piezoelectric body unit) can be transmitted to the ink cartridge 5*b*.

The recording head unit 5*a*, as the piezoelectric body unit, is configured of a glass substrate 9, a common electrode 12 extended in the main scanning direction, piezoelectric bodies 11, and segment electrodes 10, a multiple of which are formed at predetermined intervals in the main scanning direction corresponding to recording pixels. Herein, the piezoelectric body 11 being disposed in a form in which it is sandwiched between the common electrode 12 and segment electrode 10, a material exhibiting a piezoelectric property, such as lead zirconate titanate (PZT) or zinc oxide (ZnO), is used. The coupling material 13 is configured of an material exhibiting an ultrasonic wave transmission capability, such as glycerin or silicon oil.

Also, the ink cartridge 5*b* is such that, the ink I being loaded into an ink reservoir inside a casing, ink is spattered from an aperture 15.

That is, due to an electric field generated between the segment electrode 10 and common electrode 12 when a printing signal based on recording information is applied to the segment electrode 10 under the control of the unshown central calculation device, the piezoelectric body 11 sandwiched between the two electrodes vibrates, and an ultrasonic wave is generated. The ultrasonic wave generated is transmitted through the glass substrate 9, and via the coupling material 13, to the ink loaded into the ink reservoir inside the ink cartridge 5*b*. In the following description, each pixel unit acoustic energy generating unit configured by the common electrode 12 and segment electrode 10 sandwiching the piezoelectric body 11 may be called an acoustic energy generating element.

Figure 6C:
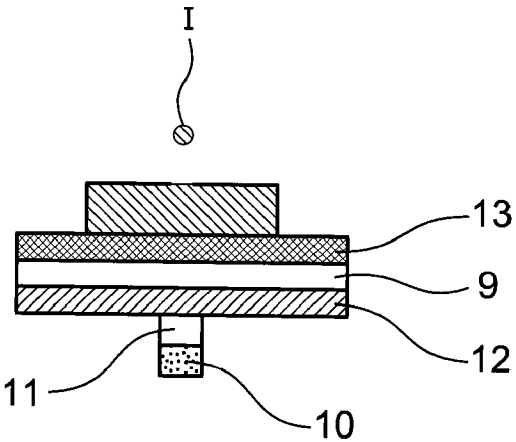
FIGS. 6A to 6C are illustrations for illustrating a spattering of ink.
Figure 6B:
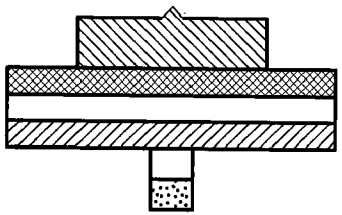
Figure 6A:
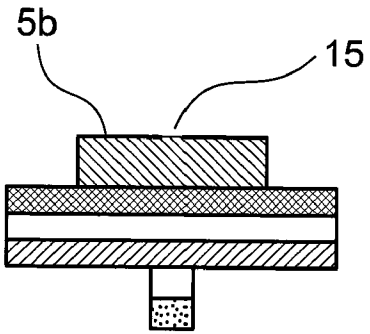

Then, as shown in FIGS. 6A to 6C, an ink meniscus is formed at the aperture 15 of the ink cartridge 5*b* by a radiation pressure occurring due to the ultrasonic wave emitted from the acoustic energy generating element and transmitted to the ink cartridge 5*b*, and the ink I is spattered.

Figure 3:
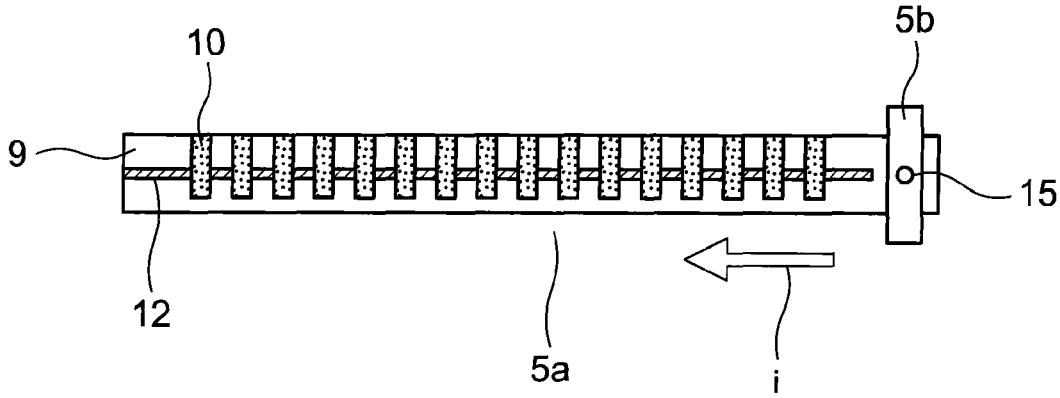
FIG. 3 is an operational illustration showing a condition of the recording head of FIG. 2 seen from a paper side.
Figure 4:
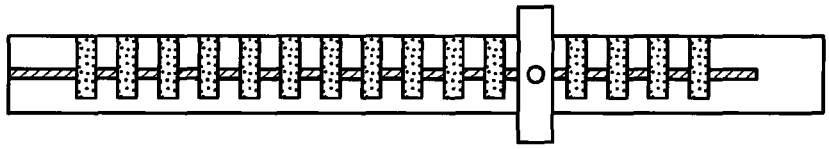
FIG. 4 is an operational illustration showing a condition of the recording head of FIG. 2 seen from the paper side.
Figure 5:
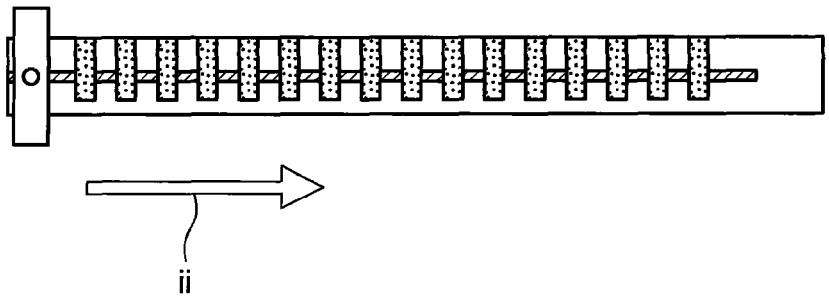
FIG. 5 is an operational illustration showing a condition of the recording head of FIG. 2 seen from the paper side.

FIGS. 3 to 5 show a condition of the recording head 5 seen from the paper P side. For the sake of the description, the coupling material 13 is omitted from the diagrams.

Herein, the ink cartridge 5*b* is installed in such a way that it can move on the recording head unit 5*a*.

Then, as shown in FIG. 3, the ink cartridge 5*b* starts moving in the direction of a main scanning direction arrow i in response to the printing signal.

On the ink cartridge 5*b* moving to a position in which is disposed an acoustic energy generating element at which printing is necessary, a voltage is applied to the segment electrode 10 and, as well as an ultrasonic wave being generated by the piezoelectric body 11, the ultrasonic wave is transmitted to the ink cartridge 5*b*, and the ink I is spattered from the aperture 15 of the ink cartridge 5*b*.

As shown in FIG. 4, when the ink cartridge 5*b* moves further and arrives at a position of an acoustic energy generating element at which a recording is necessary, a voltage is applied to the segment electrode 10, and the recording is performed. By repeating this operation, the main scanning direction printing is completed.

On the paper moving one dot's worth in a sub-scanning direction, the ink cartridge 5*b* again carries out a recording in the direction of a main scanning direction arrow ii, as shown in FIG. 5. By repeating this operation, it is possible to record by spattering ink on a necessary portion of the paper, thus completing the printing.

In this way, with the recording head unit (the piezoelectric body unit) 5*a* in a fixed condition, it is possible to carry out a recording simply by moving the ink cartridge 5*b*.

In the event that, when the ink inside the ink cartridge 5*b* decreases and the recording becomes impossible, the necessity of replacing the ink cartridge 5*b* arises, it is sufficient to replace only the ink cartridge 5*b*.

As a heretofore known ink jet printer using a piezoelectric body is one which utilizes a deformational displacement of the piezoelectric body, the structure of the ink tank is complex due to the disposition of a pressure chamber, or the like, but according to the invention, as the ink is spattered due to a radiation pressure of a generated ultrasonic wave, the structure of the ink tank is simple. Furthermore, even in the event that a problem such as an ink clogging occurs, it being sufficient to replace only the ink cartridge 5*b*, with no need to replace the expensive recording head unit 5*a*, a reduction in cost results.

Also, with a heretofore known ink jet printer utilizing a heater, there has been a problem in that the range of choice of ink materials is narrow because of the heater reaching a high temperature, but as heat is not utilized in the invention, there is a benefit in that this kind of drawback is eliminated, and any kind of ink material can be used.

According to the heretofore described configuration, as it is possible to use the ink cartridge 5*b* with the simple configuration, a reduction in cost results, and also, even in the event that a problem occurs, there is no need to replace the expensive recording head. Furthermore, as the heretofore known kind of heat is not used, there is an advantage in that there is a wide range of choice of ink materials.

Figure 7:
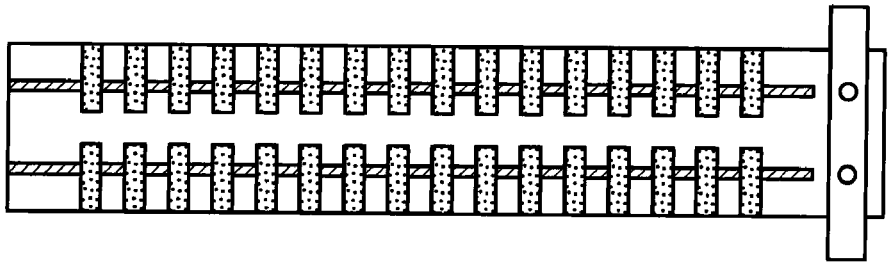
FIG. 7 is a diagram showing a modification example of the acoustic ink jet printer according to the invention.

In the heretofore described embodiment, a case is shown in which the common electrode 12 and segment electrodes 10 are disposed in one row but, the invention not being limited to this, it is also possible to increase the number of nozzles by disposing the common electrode 12 and segment electrodes 10 in a plurality of rows, as shown in FIG. 7. Then, by so doing, an increase in printing speed is possible.

Figure 8:
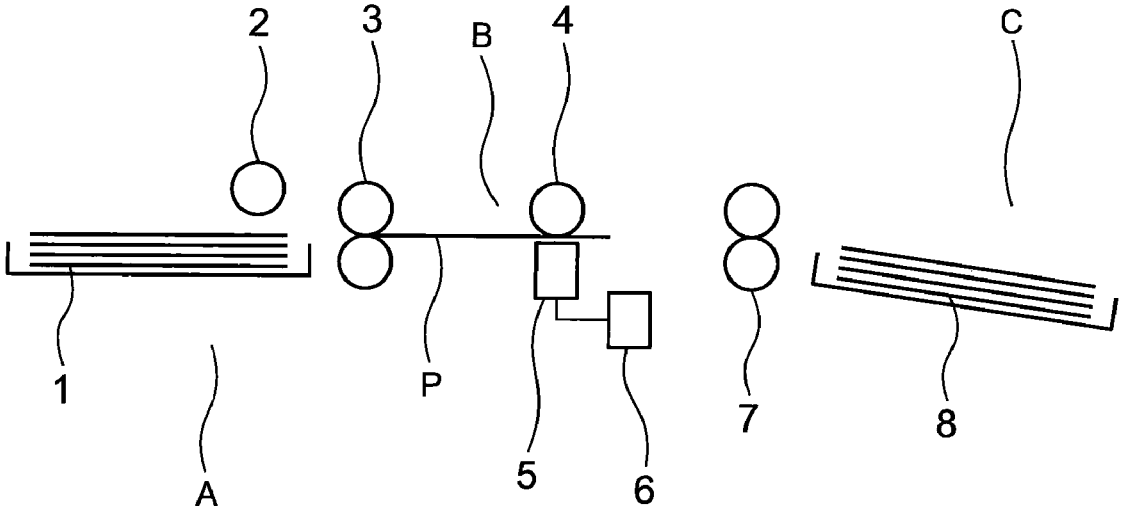
FIG. 8 is a diagram showing a further separate modification example of the acoustic ink jet printer according to the invention.

Also, as shown in FIG. 8, it is also possible to connect the ink tank 6 to the ink cartridge 5*b*, and supply ink. In this case, even in the event that the ink decreases, it is sufficient to replenish the ink in the ink tank 6.

FIGS. 9A to 12C show another embodiment of the acoustic ink jet printer according to the invention.

Herein, in this embodiment, a description will be given of a case in which, although a detailed depiction is omitted from the diagrams, the platen roller 4 and recording head 5 in the outline diagram of FIG. 1 in the previously described embodiment are disposed in reverse.

Figure 9A:
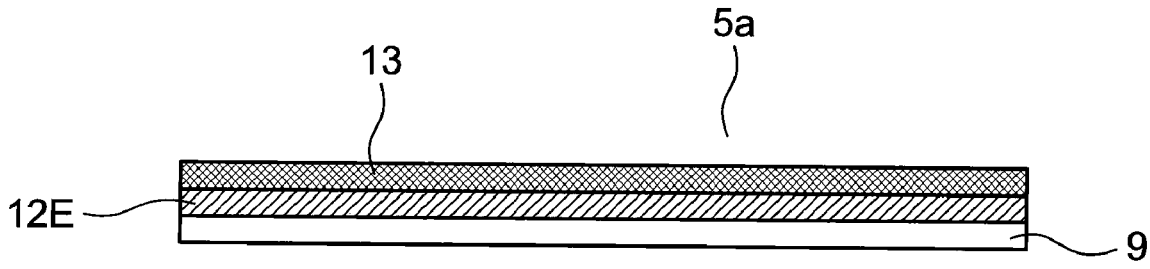
FIGS. 9A and 9B are outline diagrams of a recording head for illustrating another embodiment of the acoustic ink jet printer according to the invention.
Figure 9B:
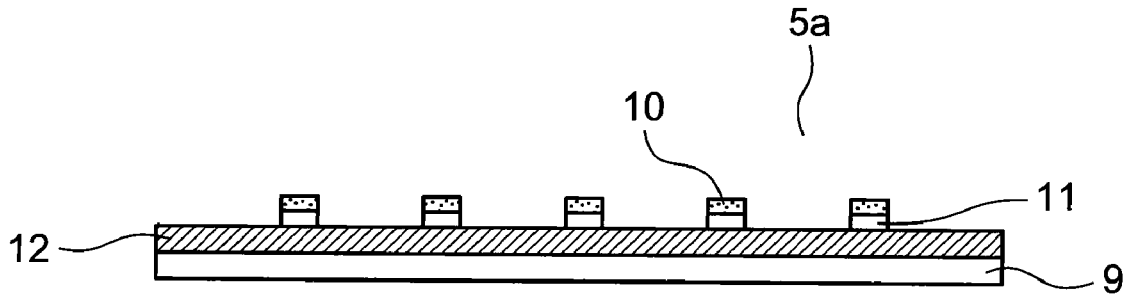

FIGS. 9A and 9B show a structure of the recording head unit 5*a*.

The recording head unit (the piezoelectric body unit) 5*a* is fixed at a size such that a recording can be carried out over the whole width of the paper (in the main scanning direction) in the recording unit B. An electrode layer 12E, and a coupling material 13, are configured on the glass substrate 9, as shown in FIG. 9A.

FIG. 9B is a diagram in which, for the sake of the description of the electrode layer 12E, the coupling material 13 is omitted.

The electrode layer 12E is configured of the common electrode 12 extended in the main scanning direction, the piezoelectric bodies 11, and the segment electrodes 10, a multiple of which are formed at predetermined intervals in the main scanning direction corresponding to the recording pixels. A voltage including a resonance frequency of the piezoelectric body 11 necessary for a printing is applied to the segment electrode 10. Due to an electric field generated between the segment electrode 10 and common electrode 12, the piezoelectric body 11 disposed between the segment electrode_10 and common electrode 12 resonates, and an ultrasonic wave is generated.

Figure 10:
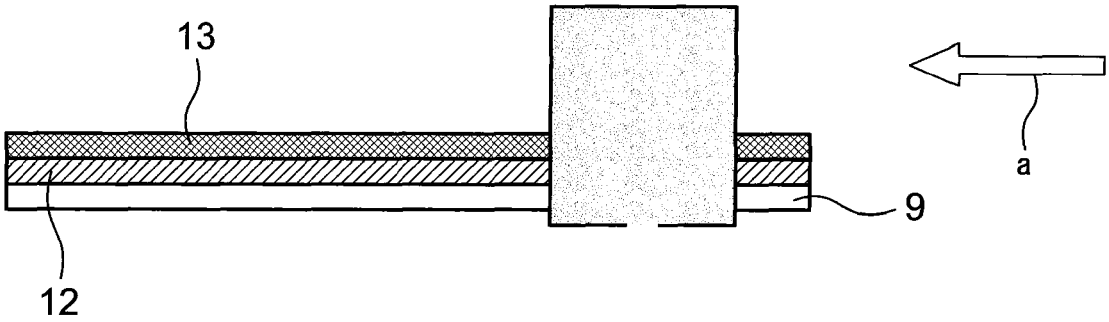
FIG. 10 is an operational illustration showing a condition of the recording head of FIGS. 9A and 9B seen from a paper side.

The recording head unit (the piezoelectric body unit) 5*a* is disposed penetrating the ink cartridge 5*b*, as shown in FIG. 10. The ink cartridge 5*b* is disposed in a condition in which it can move, by means of an unshown guide rod, timing belt, and drive motor, in response to printing information, in the paper width direction (the main scanning direction), while passing the recording head 5*a* through the interior of the ink cartridge 5*b*.

Figure 11:
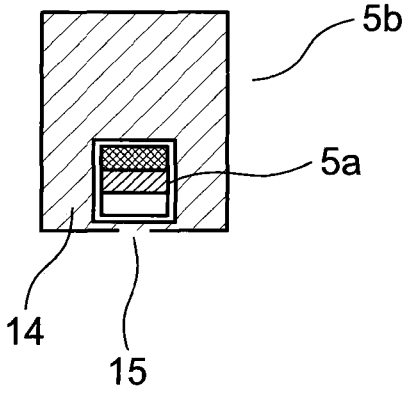

FIG. 11 shows the recording head 5 seen from the direction of an arrow a of FIG. 10.

The recording head unit 5*a* is penetrating the sides of the ink cartridge 5*b*. A structure is such that, silicon rubber 14 being disposed in the penetrated portion of the ink cartridge 5*b*, a sealing is done so that the ink inside the ink cartridge 5*b* does not leak.

The ink I being loaded inside the ink cartridge 5*b*, ink is spattered from the aperture 15 in accordance with printing data, and a printing is carried out on the paper P.

Due to an electric field generated between the segment electrode 10 and common electrode 12 when a printing signal based on recording information is applied to the segment electrode 10 under the control of the unshown central calculation device, the piezoelectric body 11 sandwiched between the two electrodes resonates, generating an ultrasonic wave. The ultrasonic wave generated is transmitted through the glass substrate 9, and applies a radiation pressure generated by the ultrasonic wave to the ink on the glass substrate 9.

Figure 12C:
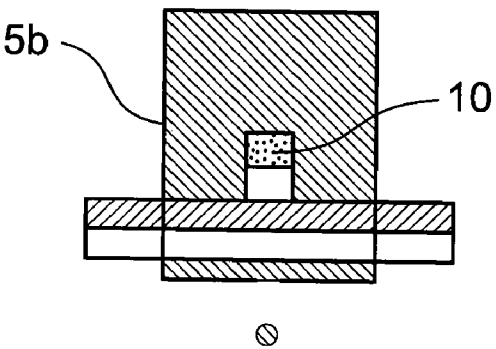
FIGS. 12A to 12C are diagrams for illustrating a movement of the recording head of FIGS. 9A, 9B, and 10.
Figure 12B:
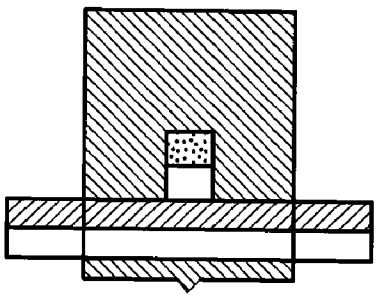
Figure 12A:
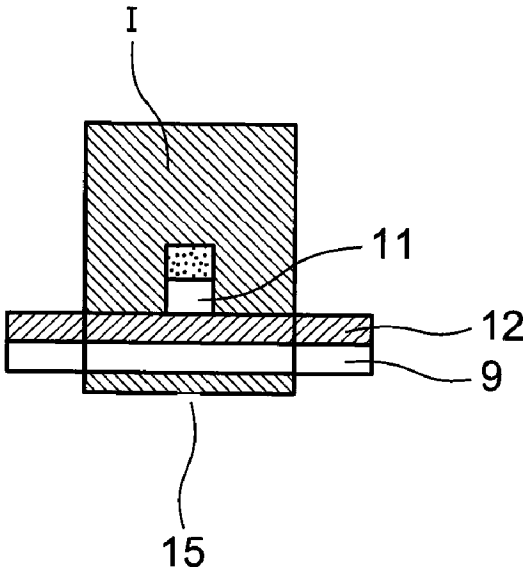

FIGS. 12A to 12C are diagrams schematically showing behavior when the ink is spattered.

As shown in FIG. 12B, a meniscus is formed at the aperture 15 of the ink cartridge 5*b* by the radiation pressure generated, after which the ink I is spattered, as shown in FIG. 12C.

Figure 13A:
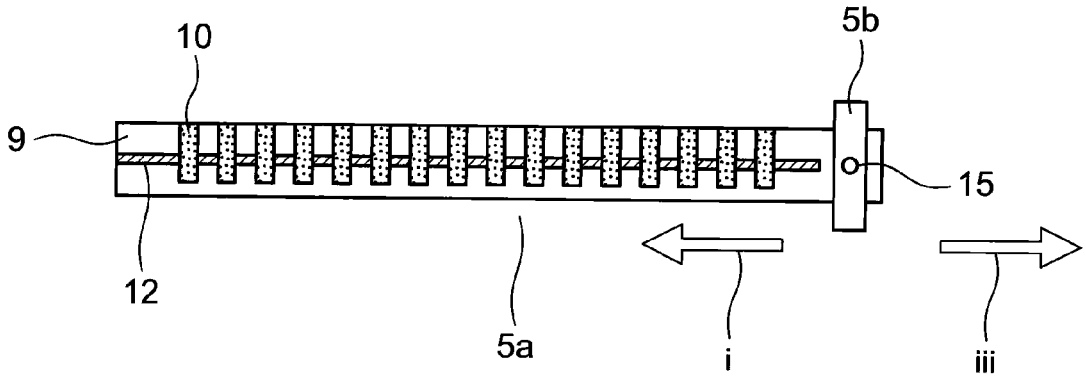
FIGS. 13A to 13C are outline diagrams showing a condition of the recording head seen from the paper side.
Figure 13B:
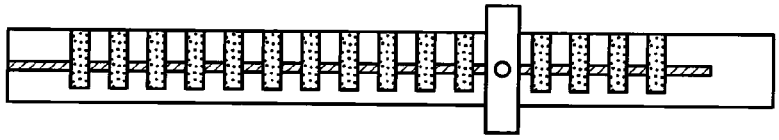
Figure 13C:
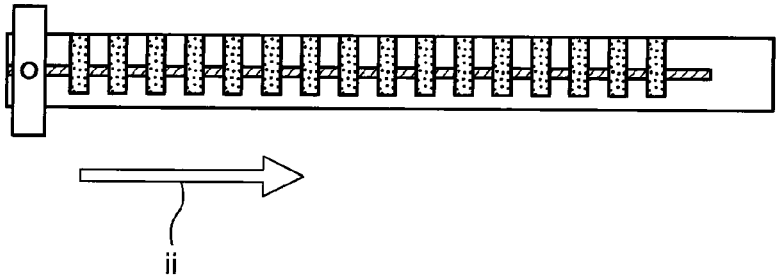

FIGS. 13A to 13C show a condition of the recording head 5 seen from the paper P side. Herein, the ink cartridge 5*b* is installed in such a way that it can move in the main scanning direction while passing the recording head unit 5*a* through its interior.

As shown in FIG. 13A, the ink cartridge 5*b* starts moving in the direction of the main scanning direction arrow i in response to the printing signal. On the ink cartridge 5*b* moving to a position of an acoustic energy generating element at which printing is necessary, a voltage is applied to the segment electrode 10 and, on an ultrasonic wave being generated by the piezoelectric body 11 resonating, a radiation pressure is generated in the ink inside the ink cartridge 5*b*, and ink is spattered from the aperture 15. As shown in FIG. 13B, when the ink cartridge 5*b* moves further and arrives at a position of an acoustic energy generating element at which a recording is necessary, a voltage is applied to the segment electrode 10, and the recording is performed. By repeating this operation, the main scanning direction printing is completed.

On the paper moving one dot's worth in the sub-scanning direction by means of a conveyor mechanism, the ink cartridge 5*b* again carries out a recording in the direction of the main scanning direction arrow ii, as shown in FIG. 13C. By repeating this operation, it is possible to record by scattering ink on a necessary portion of the paper, thus completing the printing.

In this way, with the recording head unit 5*a* in a fixed condition, it is possible to carry out a recording simply by moving the ink cartridge 5*b* in the main scanning direction.

In the event that, when the ink inside the ink cartridge 5*b* decreases and the recording becomes impossible, the necessity of replacing the ink cartridge arises, it is sufficient to replace only the ink cartridge 5*b*. That is, in order to replace the ink cartridge 5*b*, the ink cartridge 5*b* is moved in the direction of an arrow iii, and removed from the recording head unit 5*a*, as shown in FIG. 13A.

In the case of loading a new ink cartridge 5*b*, it is loaded in such a way that the recording head unit 5*a* is inserted into a through hole opened in the center of the ink cartridge 5*b*.

By means of this kind of configuration too, in the same way as with the heretofore described embodiment, various superior effects are achieved, as follows.

That is, as a heretofore known ink jet printer using a piezoelectric body is one which utilizes a deformational displacement of the piezoelectric body, the structure of the ink tank is complex due to the formation of a microchannel, or the like, in the ink tank in order to dispose a pressure chamber, but according to the invention, as the ink is spattered due to a radiation pressure of an ultrasonic wave generated by the resonance of the piezoelectric body, the pressure chamber is not needed. Consequently, the structure of the ink tank is simple.

Also, as the ink is caused to come into direct contact with the recording head unit 5*a*, the coupling material for the ultrasonic wave transmission is not needed, meaning that a simplification and reduction in cost of the apparatus result. Furthermore, even in the event that a problem such as an ink clogging occurs, it being sufficient to replace only the ink cartridge 5*b*, with no need to replace the expensive recording head unit 5*a*, a reduction in cost results.

Also, with a heretofore known ink jet printer utilizing a heater, there has been a problem in that the range of choice of ink materials is narrow because of the heater reaching a high temperature, but as heat is not utilized in the invention, there is a benefit in that any kind of ink material can be used.

Then, as it is possible, with this configuration too, to use an ink cartridge with a simple configuration, a reduction in cost results. Furthermore, even in the event that a problem such as a clogging of the nozzle occurs, as it is possible to configure with only the ink cartridge, there is no need to replace the expensive recording head. Also, as heat is not used, there is an advantage in that there is a wide range of choice of ink.

With this embodiment too, in the same way as with the heretofore described embodiment, it is possible to increase the number of nozzles by disposing the common electrode and segment electrodes in a plurality of rows.

Also, it is also possible to connect the ink tank 6 to the ink cartridge 5*b*.

Figure 14A:
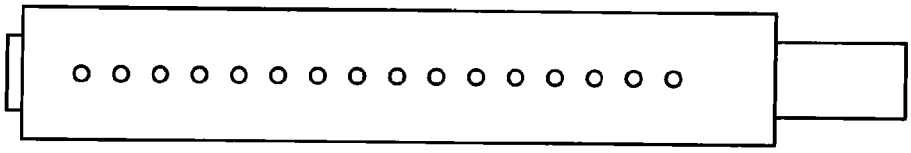
FIGS. 14A and 14B are illustrations for illustrating another embodiment of the acoustic ink jet printer according to the invention.

Also, as shown in FIG. 14A, the invention is applicable with a line head too.

Figure 14B:
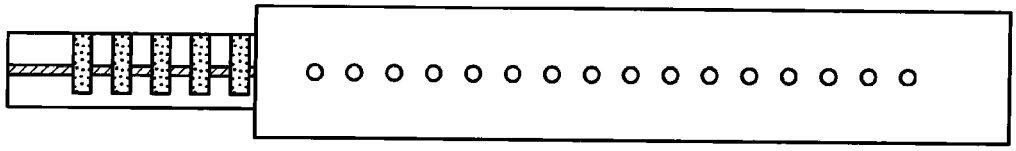

Herein, in this kind of configuration, there is an advantage in that, as it is sufficient to move the ink cartridge 5*b* from the recording head 5*a*, as in FIG. 14B, and replace only the ink cartridge 5*b* in the event that a problem such as a nozzle clogging occurs, a reduction in cost results.

Figure 15A:
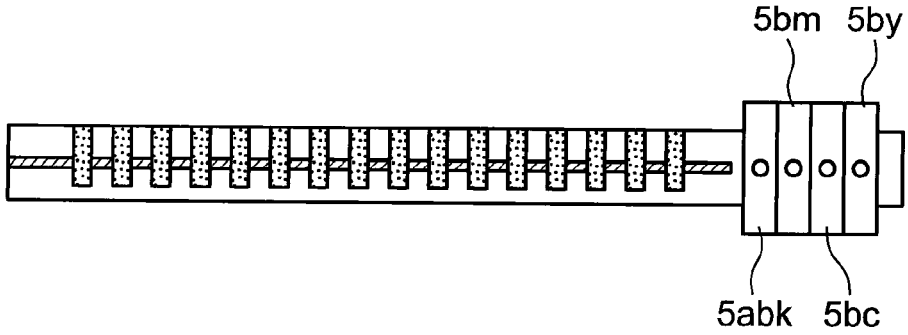
FIGS. 15A and 15B, showing another embodiment of the acoustic ink jet printer according to the invention, are diagrams for illustrating a case of colorization.
Figure 15B:
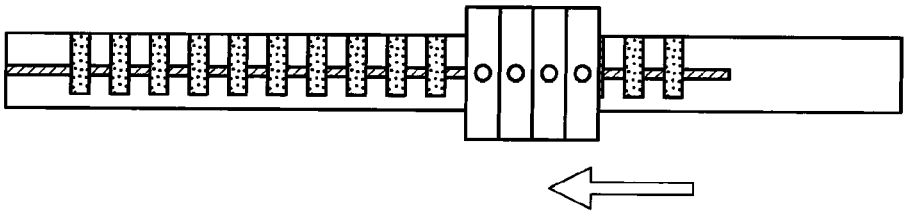

FIGS. 15A and 15B show a case of carrying out a color printing with the apparatus configuration according to the invention.

That is, a plurality of ink cartridges 5*b* are disposed on the recording head unit 5*a*, as shown in FIG. 15A.

For example, in a case of carrying out a printing in the four colors yellow, magenta, cyan, and black, four ink cartridges 5*bbk*, 5*bm*, 5*bc*, and 5*by* are disposed aligned on the recording head unit 5*a*, as shown in FIG. 15A. The ink cartridges 5*bbk*, 5*bm*, 5*bc*, and 5*by* move in the main scanning direction, in accordance with 5 printing data, as shown in FIGS. 15A and 15B.

Then, on the ink cartridges 5*bbk*, 5*bm*, 5*bc*, and 5*by* arriving above a segment electrode 10 at which printing is necessary, a voltage is applied to the segment electrode 10 in accordance with the printing data, an ultrasonic wave is generated and, for example, when carrying out a black printing, it is possible to carry out a spattering of ink from the ink cartridge 5*bbk*.

Also, in the event of printing with another color at the same segment electrode 10, in the case of, for example, magenta, the voltage is applied to the segment electrode 10 when the ink cartridge 5*bm* has moved to the position of the acoustic energy generating element, and it is possible to carry out a spattering of the ink I. As the four colors of ink cartridge 5*bbk*, 5*bm*, 5*bc*, and 5*by* move together, it is possible to carry out printing in the four colors with one recording head unit 5*a*.

Then, with a heretofore known ink jet printer, it has been necessary to prepare a plurality of colors' worth of recording heads when carrying out a printing in a plurality of colors, but according to the invention, as a color printing is possible with the one recording head unit 5*a*, the color printing is possible using a simple method, and a reduction in cost is possible.

Figure 16A:
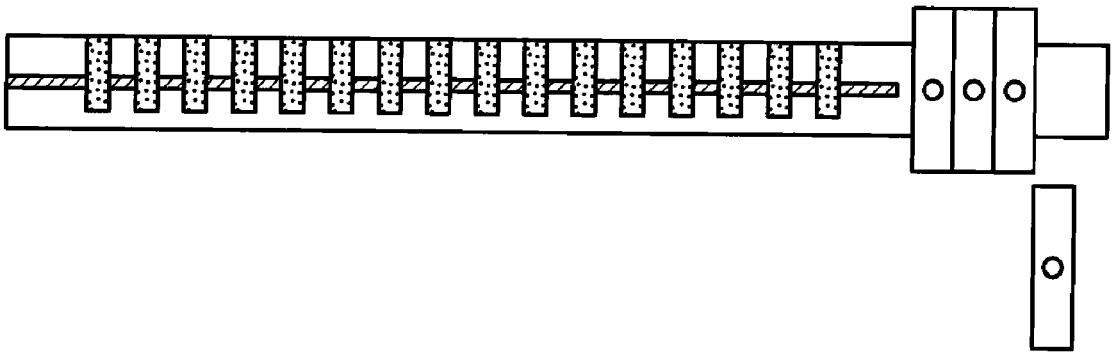
FIGS. 16A and 16B, showing still another embodiment of the acoustic ink jet printer according to the invention, are illustrations illustrating a further separate modification example of the case of colorization.
Figure 16B:
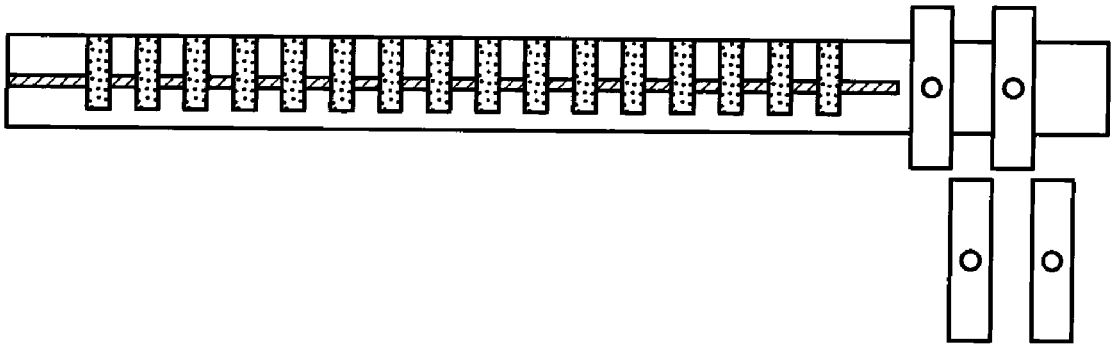

Furthermore, as shown in FIGS. 16A and 16B, by providing a place and method for setting aside the ink cartridges 5*bbk*, 5*bm*, 5*bc*, and 5*by*, it is possible to dispose only a necessary color on the recording head unit 5*a*.

Also, a capping of the ink cartridges 5*bbk*, 5*bm*, 5*bc*, and 5*by* is carried out when not printing in order to prevent the ink from drying. In the case of the invention, as it is possible, even during printing, to continue the capping, in the place for setting aside, of an ink cartridge of a color not needed for the printing, it being possible to prevent the drying of the ink, it is possible to prevent an occurrence of the ink clogging, and it is possible to provide a stable printing.

According to the heretofore described configuration, as a color printing is possible with one recording head, a color printing using a simple method is possible, and a reduction in cost is possible. Also, as there is no need to move an ink cartridge of a color not needed for the printing from the place for setting aside, it is possible to continue the capping for longer, and it is possible to obtain a more stable printing.

The invention not being limited to the structures described in the heretofore described embodiments, it goes without saying that the shape, structure and the like of each portion configuring the acoustic ink jet printer may be appropriately modified or altered.

What is claimed is:

1. An acoustic ink jet printer comprising:

a piezoelectric body unit which includes a common electrode extended in a main scanning direction to a length equivalent to a width of a recording medium, segment electrodes, a multiple of which are formed corresponding to recording pixels at predetermined intervals in the main scanning direction, and piezoelectric bodies sandwiched by the common electrode and the segment electrodes, wherein a piezoelectric body is caused to vibrate by a printing signal being applied to the segment electrode, and as a result, generates an ultrasonic wave of each recording pixel;

an ink cartridge including an ink reservoir which is supported so as to be movable in proximity to the piezoelectric body unit extended in the main scanning direction, stocks ink therein which is exposed to the ultrasonic wave, and has an aperture through which ink is discharged due to a radiation pressure caused by the ultrasonic wave;

a movement section which moves the ink cartridge along the piezoelectric body unit in accordance with recording information; a recording signal supply section which, on the ink cartridge being moved to a position corresponding to the segment electrode by the movement section, supplies a printing signal to the segment electrode based on the recording information; and a recording medium conveyor section which conveys the recording medium in a sub-scanning direction in order to move the recording medium in a vicinity of a movement trajectory along which the aperture of the ink cartridge moves.

2. An acoustic ink jet printer comprising:

a piezoelectric body unit which includes a common electrode which is extended in a main scanning direction to a length equivalent to a width of a recording medium, segment electrodes, a multiple of which are formed corresponding to recording pixels at predetermined intervals in the main scanning direction, and piezoelectric bodies sandwiched by the common electrode and the segment electrodes, wherein a piezoelectric body is caused to vibrate by a printing signal being applied to the segment electrode, and as a result, generates an ultrasonic wave of each recording pixel;

an ink cartridge including an ink reservoir which is supported so as to be movable in proximity to the piezoelectric body unit extended in the main scanning direction, stocks ink therein which is exposed to the ultrasonic wave, and has an aperture through which ink is discharged due to a radiation pressure caused by the ultrasonic wave;

a movement section which moves the ink cartridge along the piezoelectric body unit in accordance with recording information;

a recording signal supply section which, on the ink cartridge being moved to a position corresponding to the segment electrode by the movement section, supplies a printing signal to the segment electrode based on the recording information; and a recording medium conveyor section which conveys the recording medium in a sub-scanning direction in order to move the recording medium in a vicinity of a movement trajectory along which the aperture of the ink cartridge moves, and wherein the piezoelectric body unit is configured in a condition such as to penetrate the ink cartridge.

3. The acoustic ink jet printer according to claim 1, wherein:

a plurality of the ink cartridges which move in the main scanning direction along the piezoelectric body unit are disposed so as to be movable along the piezoelectric body unit.

4. The acoustic ink jet printer according to claim 3, wherein:

only a number of ink cartridges necessary according to a recording application are disposed, as the ink cartridges, so as to be movable along the piezoelectric body unit.

5. The acoustic ink jet printer according to claim 4, wherein:

the ink cartridge not utilized according to a recording application is held in a place for setting aside, and does not move.

6. The acoustic ink jet printer according to claim 5, wherein:

the ink cartridge held in the place for setting aside without being utilized according to the recording application is maintained in a capped condition.

7. The acoustic ink jet printer according to claim 4, wherein:

the differing recording applications include a black and white recording and a color recording, and in the case of a color recording, each of the plurality of ink cartridges stocks a differing color of ink therein.

8. The acoustic ink jet printer according to claim 4, wherein:

the differing recording applications include a black and white recording and a color recording, and in the case of a color recording, each of the plurality of ink cartridges stocks one of at least yellow, magenta, and cyan colored inks therein.

9. The acoustic ink jet printer according to claim 4, wherein:

the differing recording applications include a black and white recording and a color recording, and in the case of a color recording, each of the plurality of ink cartridges stocks one of black, yellow, magenta, and cyan colored inks therein.

10. The acoustic ink jet printer according to claim 1, wherein:

by a coupling material which transmits an ultrasonic wave being interposed between an external wall of the ink cartridge and the piezoelectric body unit, the ink cartridge slides along the piezoelectric body unit while maintaining a condition wherein an ultrasonic wave emitted from the piezoelectric body unit falls incident on ink inside the ink cartridge.

11. The acoustic ink jet printer according to claim 10, wherein:

the coupling material is glycerin.

12. The acoustic ink jet printer according to claim 2, wherein:

by a coupling material which transmits an ultrasonic wave being interposed between an external wall of the ink cartridge and the piezoelectric body unit, the ink cartridge slides along the piezoelectric body unit while maintaining a condition wherein an ultrasonic wave emitted from the piezoelectric body unit falls incident on ink inside the ink cartridge.

13. The acoustic ink jet printer according to claim 12, wherein:

the coupling material is glycerin.

14. The acoustic Ink jet printer according to claim 2, wherein:

a plurality of the ink cartridges which move in the main scanning direction along the piezoelectric body unit are disposed so as to be movable along the piezoelectric body unit.

15. The acoustic ink jet printer according to claim 14, wherein:

only a number of ink cartridges necessary according to a recording application are disposed, as the ink cartridges, so as to be movable along the piezoelectric body unit.

16. The acoustic ink jet printer according to claim 15, wherein:

the ink cartridge not utilized according to a recording application is held in a place for setting aside, and does not move.

17. The acoustic ink jet printer according to claim 16, wherein:

the ink cartridge held in the place for setting aside without being utilized according to the recording application is maintained in a capped condition.

18. The acoustic ink jet printer according to claim 15, wherein:

the differing recording applications include a black and white recording and a color recording, and in the case of a color recording, each of the plurality of ink cartridges stocks a differing color of ink therein.

19. The acoustic ink jet printer according to claim 15, wherein:

the differing recording applications include a black and white recording and a color recording, and in the case of a color recording, each of the plurality of ink cartridges stocks one of at least yellow, magenta, and cyan colored inks therein.

20. The acoustic ink jet printer according to claim 15, wherein:

the differing recording applications include a black and white recording and a color recording, and in the case of a color recording, each of the plurality of ink cartridges stocks one of black, yellow, magenta, and cyan colored inks therein.

* * * * *